US011015309B2

(12) United States Patent
Song et al.

(10) Patent No.: US 11,015,309 B2
(45) Date of Patent: May 25, 2021

(54) FLEXIBLE BARRIER AND DESIGNING METHOD THEREOF

(71) Applicant: Institute of Mountain Hazards and Environment, Chinese Academy of Sciences, Sichuan (CN)

(72) Inventors: Dongri Song, Sichuan (CN); Gongdan Zhou, Sichuan (CN); Hongsen Hu, Sichuan (CN); Shuai Li, Sichuan (CN)

(73) Assignee: Institute of Mountain Hazards and Environment, Chinese Academy of Sciences, Sichuan (CN)

( * ) Notice: Subject to any disclaimer, the term of this patent is extended or adjusted under 35 U.S.C. 154(b) by 443 days.

(21) Appl. No.: 16/008,019

(22) Filed: Jun. 13, 2018

(65) Prior Publication Data

US 2018/0291571 A1 Oct. 11, 2018

(30) Foreign Application Priority Data

Dec. 12, 2017 (CN) ..... 201711317935.2

(51) Int. Cl.
*E01F 7/04* (2006.01)

(52) U.S. Cl.
CPC ..... *E01F 7/045* (2013.01)

(58) Field of Classification Search
CPC ..... E01F 7/00; E01F 7/02; E01F 7/04; E01F 7/045; E04H 17/02; E04H 17/04; E04H 17/08; Y02A 10/23
USPC ..... 256/12.5
See application file for complete search history.

(56) References Cited

U.S. PATENT DOCUMENTS 4,730,810 A * 3/1988 Rambaud ..... E01F 7/045 256/12.5
4,819,915 A * 4/1989 Cargnel ..... E01F 7/045 256/12.5

FOREIGN PATENT DOCUMENTS

CH 357085 A * 9/1961 ..... E01F 7/04
DE 102006013526 A1 * 8/2007 ..... E01F 7/045
EP 1500747 A1 * 1/2005 ..... E01F 7/045
EP 3124700 A1 * 2/2017 ..... E01F 7/04
FR 2629492 A1 * 10/1989 ..... E01F 7/045
FR 2669047 A1 * 5/1992 ..... E01F 7/045

* cited by examiner

*Primary Examiner* — Josh Skroupa

(57) ABSTRACT

A flexible barrier includes: posts, retaining ropes and a metal net; wherein each of the posts comprises a post body and a post foundation hinged; the retaining ropes includes longitudinal retaining ropes, top retaining ropes, intermediate retaining ropes, and diagonal retaining ropes connected between the posts and the metal net; wherein a lower portion of the metal net is obliquely arranged towards a downstream of a slope; the metal net is loose when no impact is applied and a bottom of the metal net is fixed with short anchors; the bottom of the metal net has a redundancy and is folded towards a upstream of the slope or buried in the slope.

7 Claims, 3 Drawing Sheets

FLEXIBLE BARRIER AND DESIGNING METHOD THEREOF

CROSS REFERENCE OF RELATED APPLICATION

The present invention claims priority under 35 U.S.C. 119(a-d) to CN 2017113179352, filed Dec. 12, 2017.

BACKGROUND OF THE PRESENT INVENTION

Field of Invention

The present invention relates to a flexible protection structure, and more particularly to a flexible barrier and a designing method thereof for blocking moving loose soil mass such as debris flow and granular avalanche.

Description of Related Arts

Compared with rigid reinforced concrete structures, flexible barriers have many advantages such as excellent buffering performance, good permeability, easy construction and installation, and environmental friendliness, which have been widely recognized in geological hazards, traffic, mining and other fields. The conventional flexible barrier styling products are derived from the demand for rockfall protection, and mainly include high-strength metal nets, posts, retaining ropes, anchor ropes, energy dissipating devices and corresponding fixed foundations. In practical applications, it is found that flexible barriers for rockfall protection also have a good blocking effect on hazards caused by loose moving soil mass such as debris flow, and then a series of improved flexible barriers against debris flow and other hazards are evolved.

The main difference between the impact of rockfall and the impact of loose soil mass is that the impact of rockfall is mainly characterized by the impulse point load. The kinetic energy of the rock is mainly dissipated by the flexible barrier and the additional energy dissipating device. The impact load of the loose soil mass is surface distributed, and the continuous impact duration is long, wherein a considerable part (even most) of the kinetic energy is dissipated by internal shearing of the soil mass. The energy dissipating efficiency of this internal shearing depends on the shear strength of the soil mass while the shear strength of soil mass depends on the stress state thereof, namely the magnitude of the positive pressure perpendicular to the shearing surface.

The conventional flexible barrier styling products are all evolved from the rockfall protection flexible barrier, inheriting the characteristics that the metal net of the falling rock protection flexible barrier net intersecting with the slope surface vertically or with a large angle (close to 90 degrees). That is to say, rocks or loose soil mass moving down along the slop impact the flexible barrier almost perpendicularly. This kind of blocking method is very reasonable for the point load of rockfall impact, but for the impact of loose soil mass, it is obvious that the shear strength characteristics related to the stress (pressure) state of the soil mass are not fully utilized for blocking the high-speed impact and efficient dissipation of kinetic energy. Meanwhile, the volume (mass) of loose soil mass is generally much larger than that of a single rockfall, when it acts on a metal net perpendicular to the slope surface, a larger internal force of the structure is generated, easily causing local damage or even the overall instability. Therefore, such design is unreasonable. The key point of the above problem lies in not distinguishing the characteristics of the rockfall and the loose soil mass, which also indicates that there is room for further improvement for the flexible barrier of the loose soil mass (debris flow, granular avalanche, etc.) impact protection.

SUMMARY OF THE PRESENT INVENTION

To solve and overcome the problem that the conventional flexible barrier cannot fully utilize the strength of the loose soil mass and overall internal force of the flexible barrier is too high under impact, an object of the present invention is to provide a flexible barrier and a designing method thereof, which have a reasonable structure and can fully take advantage of the strength of the soil mass itself to block moving soil mass and systematically reduce the structure internal force.

Accordingly, in order to accomplish the above object, the present invention provides:

a flexible barrier, comprising: a plurality of posts, a plurality of retaining ropes and a metal net; wherein each of the posts comprises a post body and a post foundation hinged to a bottom end of the post body; the retaining ropes are connected between the posts, comprising longitudinal retaining ropes connected between tops and bottoms of the posts, top retaining ropes which are latitudinally extended and connected between the tops of the posts, intermediate retaining ropes latitudinally running through the whole metal net, and diagonal retaining ropes diagonally running through the whole metal net; wherein a lower portion of the metal net is obliquely arranged towards a downstream of a slope; the metal net is loose when no impact is applied and a bottom of the metal net is fixed with short anchors; the bottom of the metal net has a redundancy and is folded towards a upstream of the slope or buried in the slope; an upper portion of the metal net is connected to the top retaining ropes while a middle portion of the metal net is connected to the intermediate retaining ropes.

Preferably, the intermediate retaining ropes latitudinally runs through the whole metal net and are anchored to two side slope surfaces; first ends of the longitudinal retaining ropes are connected to the tops of the posts; second ends of the longitudinal retaining ropes pass through the metal net which is obliquely arranged towards the downstream of the slope and reach the bottom of the metal net, and then moves upwards along a slope surface to reach the post foundation of a same post.

Preferably, top ends of the diagonal retaining ropes are connected to the tops of the posts; bottom ends of the diagonal retaining ropes pass through the bottom of the metal net which is obliquely arranged towards the downstream of the slope, and then moves upwards to reach the post foundation of an adjacent post.

Preferably, the lower portion of the metal net is obliquely arranged towards the downstream of the slope, which forms an angle of 0-60 degrees with a horizontal plane.

Preferably, the posts comprise at least two border posts and intermediate posts between the border posts; for ensuring balance of the posts, tops of the border posts and the intermediate posts are connected to anchor ropes which are oblique towards the upstream of the slope.

Preferably, energy dissipating devices are connected to top ends of the longitudinal retaining ropes, the diagonal retaining ropes and the anchor ropes as well as both ends of the top retaining ropes and the intermediate retaining ropes, so as to buffer an impulse load of an impact and provide a larger flexible deformation.

Preferably, the top retaining ropes are tensioned by the border posts and the intermediate posts.

A designing method or principle of a flexible barrier comprises steps of:

(1) as a frictional material, calculating a stress (pressure)-dependent shear strength of soil mass as:

$$\tau=c+\mu\sigma \quad (1)$$

wherein in the equation (1), τ is the shear strength of the soil mass, c is a cohesion of the soil mass, μ is a coefficient of friction of the soil mass, and a is a normal stress of the soil mass;

(2) maintaining a small angle between the flexible barrier and a slope surface; linearly improving a shear resistance at unit width of the flexible barrier through a pressure P applied on the soil mass by the flexible barrier; when:

$$f<c+\mu N=c+\mu(P\cos\psi+G\cos\theta) \quad (2)$$

moving soil mass tends to be stopped and static soil mass is still; in the equation (2), ƒ is a friction resistance between the slope surface and the soil mass, N is a support force applied on the soil mass by the slope surface, P is the pressure applied on the soil mass by the flexible barrier, G is a gravity force of the soil mass, ψ is an angle between the slope surface and a surface of the soil mass, and θ is an angle between the slope surface and a horizontal plane; friction between the flexible barrier and the soil mass is ignored and cohesion c of the soil mass is generally negligible; and (3) maintaining the small angle between the flexible barrier and the slope surface for improving an internal force T of longitudinal retaining ropes of the flexible barrier, wherein a relationship between the internal force T of the longitudinal retaining ropes of the flexible barrier and an impact force of the moving soil mass is:

$$T=F/\cos(\psi+\theta) \quad (3)$$

wherein in the equation (3), T is the internal force of the longitudinal retaining ropes, F is the impact force applied on the flexible barrier by the soil mass; when an angle ψ+θ between the flexible barrier and the slope surface is nearly perpendicular, the internal force T of the longitudinal ropes tends to be infinite;

wherein the internal force T of the longitudinal retaining ropes decreases when the a ψ between the slope surface and the surface of the soil mass decreases.

Preferably, when the longitudinal retaining ropes are omitted, an internal force of the metal net tends to be infinite.

Beneficial Effects:

The flexible barrier of the present invention has a reasonable layout, which can fully take advantage of the strength of the loose soil mass to block the moving soil mass and systematically reduce the internal force of the structure, wherein the specific advantages are embodied in the following points:

(1) When the loose soil mass impacts the flexible barrier for the first time, the barrier exerts a retaining pressure on the soil mass, which increases the restriction force of the soil mass, thereby increasing the shear strength thereof, and promoting the kinetic energy dissipation of the moving soil mass as well as increasing blocking efficiency.

(2) On the other hand, when the subsequent loose soil mass impacts the flexible barrier, which actually impacts static soil mass. This part of the soil mass is under the restriction of the flexible barrier with high shear strength and anti-sliding capacity. Additionally, coupled with its own inertial mass, it can easily stop the subsequent moving soil mass. That is to say, the static soil mass is no longer simply the load of the flexible barrier, but is a composed structure of the flexible barrier and the static soil mass that can effectively block the impact of the subsequent soil mass.

(3) From the perspective of structural force, under the same impact force, the small angle between the flexible barrier and the slope surface can systematically reduce the internal force of the retaining rope.

In the above three aspects, the flexible barrier with a tilt angle can significantly increase the bearing capacity, optimize the internal force of the structure, reduce the amount of material used and maintenance cost at a later stage, and improve the cost performance of the protection project. The present invention provides the flexible barrier that blocks all kinds of loose moving objects, and is especially suitable for blocking debris flow, granular avalanche, etc.

These and other objectives, features, and advantages of the present invention will become apparent from the following detailed description, the accompanying drawings, and the appended claims.

BRIEF DESCRIPTION OF THE DRAWINGS

Referring to FIGS. 4 and 5, P is the pressure applied on the soil mass by the flexible barrier, G is a gravity force of the soil mass, N is a support force applied on the soil mass by the slope surface, ƒ is a friction resistance between the slope surface and the soil mass, ψ is an angle between the slope surface and a surface of the soil mass, and θ is an angle between the slope surface and a horizontal plane, F is the impact force applied on the flexible barrier by the soil mass, and T is the internal force of the longitudinal retaining ropes.

DETAILED DESCRIPTION OF THE PREFERRED EMBODIMENT

Figure 1:
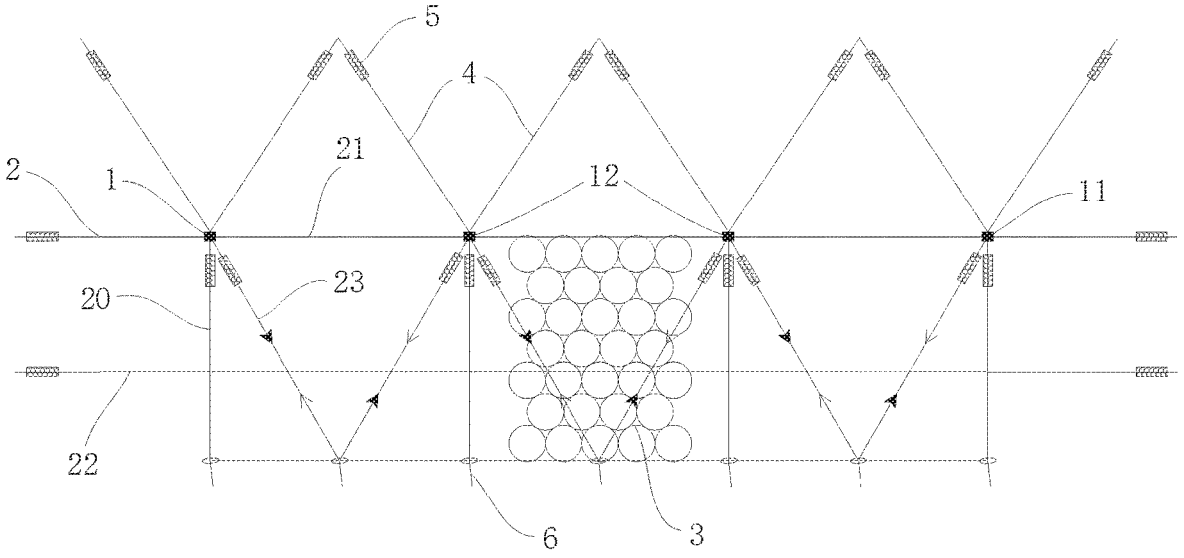
FIG. 1 is a top plane view of a flexible barrier of the present invention.

Referring to the drawings and embodiments, the present invention will be further illustrated.

Referring to FIG. 1, a flexible barrier of the present invention comprises: a plurality of posts 1, a plurality of retaining ropes 2, a metal net 3, anchor ropes 4, energy dissipating devices 5 and short anchors 6.

The posts 1 comprise two border posts 11 and intermediate posts 12 between the border posts 11; for ensuring balance of the posts 1, tops of the border posts 11 and the intermediate posts 12 are connected to the anchor ropes 4 which are oblique towards the upstream of the slope. Each of the posts 1, namely the border posts 11 and the intermediate posts 12, comprises a post body and a post foundation hinged to a bottom end of the post body.

The retaining ropes 2 are connected between the posts 1, comprising longitudinal retaining ropes 20 connected between tops and bottoms of the posts 1, top retaining ropes 21 which are latitudinally extended and connected between the tops of the posts 1, intermediate retaining ropes 22 latitudinally running through the whole metal net 3, and diagonal retaining ropes 23 diagonally running through the whole metal net 3; wherein the top retaining ropes 21 are tensioned by the border posts 11 and the intermediate posts 12. The intermediate retaining ropes 22 latitudinally runs through the whole metal net 3 and are anchored to two side slope surfaces; two diagonal retaining ropes 23 are connected between each adjacent posts 1, wherein the diagonal retaining ropes 23 and the intermediate ropes 22 are not essential and can be modified according to a slope angle and a scale of loose soil mass. First ends of the longitudinal retaining ropes 20 are connected to the tops of the border posts 11 (or intermediate posts 12) of the posts 1; second ends of the longitudinal retaining ropes 20 pass through the metal net 3 which is obliquely arranged towards the downstream of the slope and reach the bottom of the metal net 3, and then moves upwards along a slope surface to reach the post foundation of the same border posts 11 (or intermediate posts 12). Top ends of the two diagonal retaining ropes 23 between each adjacent posts 1 are connected to the tops of the adjacent posts 1; bottom ends of the diagonal retaining ropes 23 pass through the bottom of the metal net 3 which is obliquely arranged towards the downstream of the slope, and then moves upwards to respectively reach the post foundation of adjacent posts 1, which means the two diagonal retaining ropes 23 of an interval intersect and pass through the bottom of the metal net 3, and then are connected to the post foundation of the adjacent posts 1.

Figure 2:
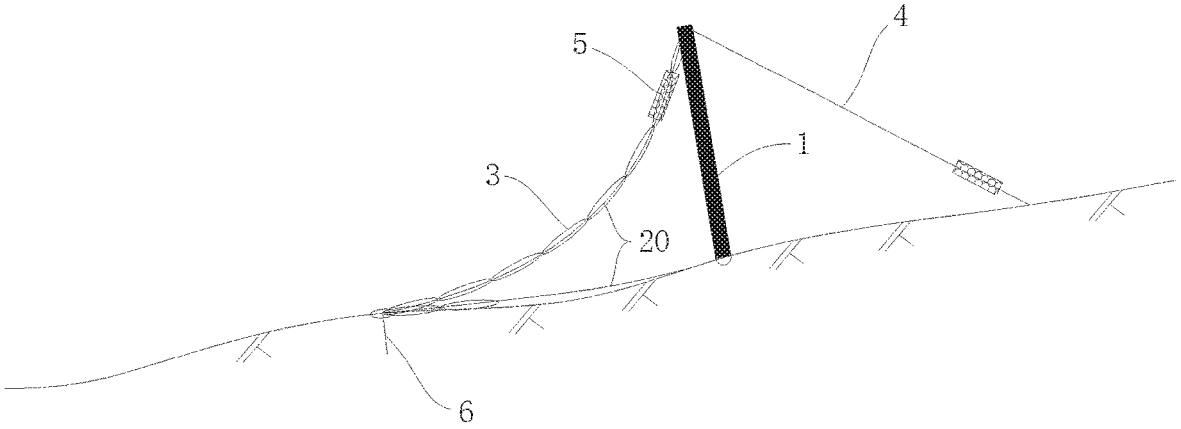
FIG. 2 is a side view of the flexible barrier of the present invention.

Referring to FIG. 2, an upper portion of the metal net 3 is connected to the top retaining ropes 21 of the retaining ropes 2 while a middle portion of the metal net 3 is to connected to the intermediate retaining ropes 22, wherein the lower portion of the metal net is obliquely arranged towards the downstream of the slope, which forms an angle of 0-60 degrees with a horizontal plane, and the angle can be adjust according to the slope angle. The metal net 3 is loose when no impact is applied and a bottom of the metal net 3 is fixed with the short anchors 6; the bottom of the metal net 3 has a redundancy and is folded towards an upstream of the slope or buried in the slope.

The energy dissipating devices 5 are connected to top ends of the longitudinal retaining ropes 20, the diagonal retaining ropes 23 and the anchor ropes 4 as well as both ends of the top retaining ropes 21 and the intermediate retaining ropes 22, so as to buffer an impulse load of an impact and provide a larger flexible deformation; wherein the energy dissipating devices 5 can be arranged with different quantities, positions and forms according to actual requirements.

Figure 3:
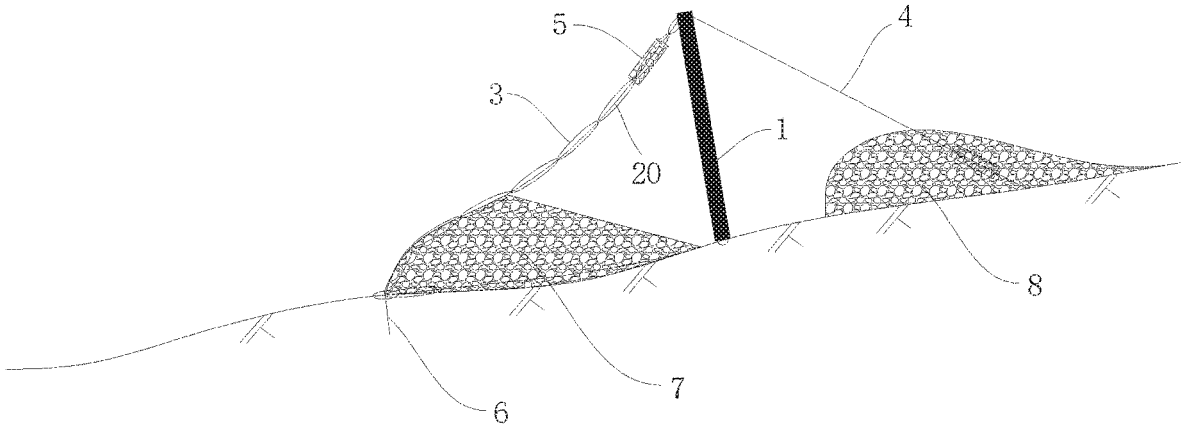
FIG. 3 illustrates the flexible barrier of the present invention when being impacted by loose soil mass.
Figure 4:
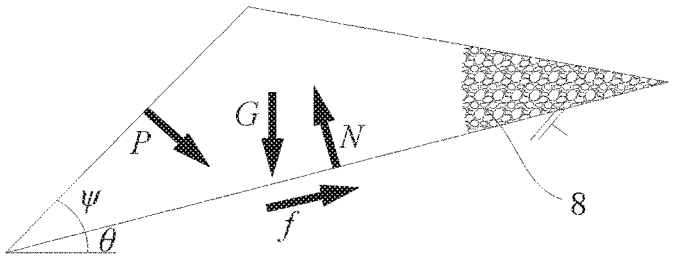
FIG. 4 illustrates force analysis of the loose soil mass.

Referring to FIG. 3, the flexible barrier of the present invention is under a tension state after being impacted, and the loose soil mass 7 in the impact process is constrained by the flexible barrier, wherein force analysis thereof is shown in FIG. 4. The subsequent moving loose soil mass 8 directly impacts the loose soil mass 7 instead of the flexible barrier itself.

Figure 5:
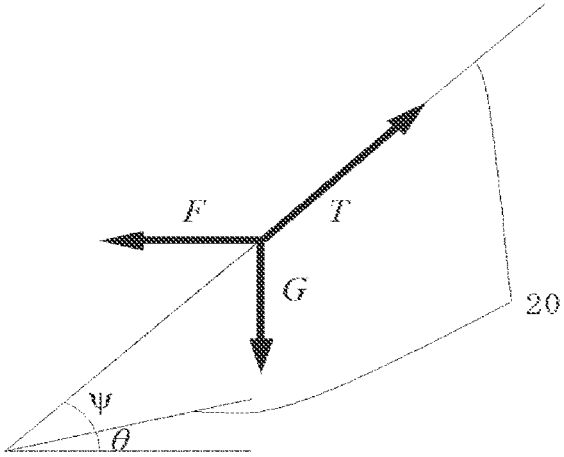
FIG. 5 illustrates force analysis of a longitudinal retaining rope of the flexible barrier of the present invention.

Referring to FIG. 5, the impact force F applied on the flexible barrier by the longitudinal retaining ropes 20, a gravity force G of the soil mass and an internal force T of the longitudinal retaining ropes 20 are balanced.

Figure 6:
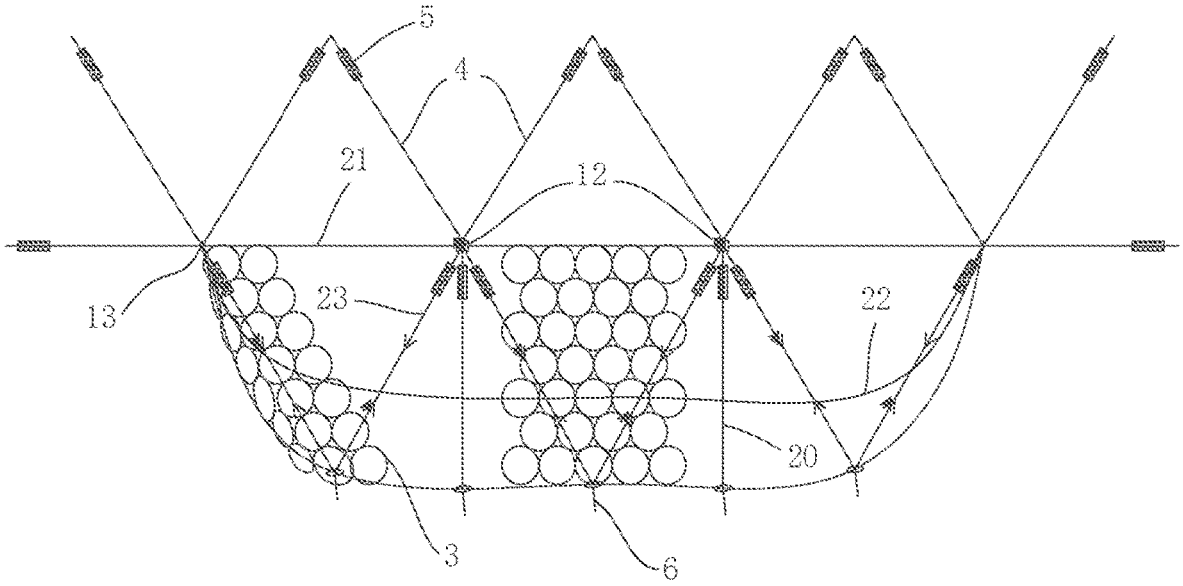
FIG. 6 is a top plane view of the flexible barrier according to another embodiment of the present invention.

The main difference between the flexible barriers shown in FIG. 6 and FIG. 1 is that the applied terrain conditions are different. The flexible barrier shown in FIG. 1 is mainly applicable to hill-slope debris flow and granular avalanche, which means the loose soil body moves downwards along the flat slope, and the barrier can extend indefinitely in the width direction. However, the flexible barrier shown in FIG. 6 is mainly applicable to channelized debris flow and granular avalanche, which means two sides of to the loose soil mass moving downwards are constrained within a U-shape channel. The specific implementation is as follows: the border posts 11 are replaced by up-down arranged anchors 13 which are anchored on two side walls of the U-shape channel, and the intermediate posts 12 can be omitted if a width of the U-shaped channel is relatively small; the metal net 3 is converged from two sides of the barrier to the up-down arranged anchors 13, and is generally pocket-like; the intermediate retaining ropes 22 are no longer directly anchored on the slope surface, but is directly connected to the anchors 13.

A designing method or principle of the flexible barrier comprises steps of:

(1) as a frictional material, calculating a stress (pressure)-dependent shear strength of soil mass as:

$$\tau=c+\mu\sigma \tag{1}$$

wherein in the equation (1), $\tau$ is the shear strength of the soil mass, c is a cohesion of the soil mass, $\mu$ is a coefficient of friction of the soil mass, and $\sigma$ is a normal stress of the soil mass;

(2) maintaining a small angle between the flexible barrier and a slope surface; linearly improving a shear resistance at unit width of the flexible barrier through a pressure P applied on the soil mass by the flexible barrier (force analysis is shown in FIGS. 3 and 4); when:

$$f<c+\mu N=c+\mu(P\cos\psi+G\cos\theta) \tag{2}$$

moving soil mass tends to be stopped and static soil mass is still; in the equation (2), $f$ is a friction resistance between the slope surface and the soil mass, N is a support force applied on the soil mass by the slope surface, P is the pressure applied on the soil mass by the flexible barrier, G is a gravity force of the soil mass, $\psi$ is an angle between the slope surface and a surface of the soil mass, and $\theta$ is an angle between the slope surface and a horizontal plane; friction between the flexible barrier and the soil mass is ignored and cohesion c of the soil mass is generally negligible; and (3) maintaining the small angle between the flexible barrier and the slope surface for improving an internal force T of longitudinal retaining ropes of the flexible barrier (force analysis is shown in FIG. 5), wherein a relationship between the internal force T of the longitudinal retaining ropes of the flexible barrier and an impact force of the moving soil mass is:

$$T=F/\cos(\psi+\theta) \tag{3}$$

wherein in the equation (3), T is the internal force of the longitudinal retaining ropes, F is the impact force applied on the flexible barrier by the soil mass; when an angle $\psi+\theta$ between the flexible barrier and the slope surface is nearly perpendicular, the internal force T of the longitudinal ropes tends to be infinite; wherein the internal force T of the longitudinal retaining ropes decreases when the angle $\psi$ between the slope surface and the surface of the soil mass decreases; when the longitudinal retaining ropes are omitted, an internal force of the metal net tends to be infinite.

The structure design of the present invention is simple and reasonable, and can fully take advantage of the strength of the loose soil mass to block the movement thereof and systematically reduce the internal force of the structure, which effectively overcomes problems that the conventional flexible barrier cannot fully utilize the strength of the loose soil mass and overall internal force of the flexible barrier is too high under impact.

One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A flexible barrier, comprising:

a plurality of posts, wherein each of the posts comprises a post body and a post foundation hinged to a bottom end of the post body;

a metal net, wherein a lower portion of the metal net is obliquely arranged towards a downstream of a slope; the metal net is loose when no impact is applied and a bottom of the metal net is fixed with short anchors; the bottom of the metal net has a redundancy and is folded towards a upstream of the slope or buried in the slope; and a plurality of retaining ropes, wherein the retaining ropes are connected between the posts, comprising:

longitudinal retaining ropes connected between tops and bottoms of the posts, top retaining ropes which are latitudinally extended and connected between the tops of the posts, intermediate retaining ropes latitudinally running through the whole metal net, and diagonal retaining ropes diagonally running through the whole metal net;

wherein an upper portion of the metal net is connected to the top retaining ropes while a middle portion of the metal net is connected to the intermediate retaining ropes.

2. The flexible barrier, as recited in claim 1, wherein the intermediate retaining ropes latitudinally runs through the whole metal net and are anchored to two side slope surfaces; first ends of the longitudinal retaining ropes are connected to the tops of the posts; second ends of the longitudinal retaining ropes pass through the metal net which is obliquely arranged towards the downstream of the slope and reach the bottom of the metal net, and then moves upwards along a slope surface to reach the post foundation of same posts.

3. The flexible barrier, as recited in claim 1, wherein top ends of the diagonal retaining ropes are connected to the tops of the posts; bottom ends of the diagonal retaining ropes pass through the bottom of the metal net which is obliquely arranged towards the downstream of the slope, and then moves upwards to reach the post foundation of adjacent posts.

4. The flexible barrier, as recited in claim 1, wherein the lower portion of the metal net is obliquely arranged towards the downstream of the slope, which forms an angle of 0-60 degrees with a horizontal plane.

5. The flexible barrier, as recited in claim 1, wherein the posts comprise at least two border posts and intermediate posts between the border posts; for ensuring balance of the posts, tops of the border posts and the intermediate posts are connected to anchor ropes which are oblique towards the upstream of the slope.

6. The flexible barrier, as recited in claim 5, wherein energy dissipating devices are connected to top ends of the longitudinal retaining ropes, the diagonal retaining ropes and the anchor ropes as well as both ends of the top retaining ropes and the intermediate retaining ropes, so as to buffer an impulse load of an impact and provide a larger flexible deformation.

7. The flexible barrier, as recited in claim 5, wherein the top retaining ropes are tensioned by the border posts and the intermediate posts.

* * * * *